US006065175A

United States Patent [19]

Tejerina

[11] Patent Number: 6,065,175

[45] Date of Patent: May 23, 2000

[54] FLOORING MOPPING SYSTEM

[76] Inventor: Silvia Reyero Tejerina, 1004 Delaware St., Scranton, Pa. 18509

[21] Appl. No.: 09/133,458

[22] Filed: Aug. 13, 1998

[51] Int. Cl.[7] ..... A47L 13/58

[52] U.S. Cl. ..... 15/116.1; 15/260; 15/263

[58] Field of Search ..... 15/111, 118, 116.1, 15/147.1, 147.2, 148–153, 228, 229.1, 229.2, 229.6, 260, 263, 264; 220/697, 699, 735, 736

[56] References Cited

U.S. PATENT DOCUMENTS

| | | | |
|---|---|---|---|
| 1,175,510 | 3/1916 | Ellis | 15/228 |
| 3,147,502 | 9/1964 | Richards | 15/118 |
| 3,199,139 | 8/1965 | Vallis | 15/118 |
| 4,722,113 | 2/1988 | Olsson | 15/264 |
| 4,735,332 | 4/1988 | Thumser | 15/260 |
| 5,414,892 | 5/1995 | Clark | 15/263 |
| 5,937,471 | 8/1999 | Liao | 15/228 |

FOREIGN PATENT DOCUMENTS

| | | | |
|---|---|---|---|
| 614644 | 9/1994 | European Pat. Off. | 15/260 |

*Primary Examiner*—Terrence R. Till

[57] ABSTRACT

A mopping system is provided including a bucket with an open top having an upper peripheral edge. Mounted on the upper peripheral edge of the bucket is a drain which is adapted to cover only a portion of the open top for permitting access to the bucket with a mop head and further allowing the removal of fluid from the mop head.

8 Claims, 2 Drawing Sheets

FLOORING MOPPING SYSTEM

BACKGROUND OF THE INVENTION

1. Field of the Invention

The present invention relates to mops and related buckets and more particularly pertains to a new floor mopping system for conveniently mopping a floor in an effective manner.

2. Description of the Prior Art

The use of mops and related buckets is known in the prior art. More specifically, mops and related buckets heretofore devised and utilized are known to consist basically of familiar, expected and obvious structural configurations, notwithstanding the myriad of designs encompassed by the crowded prior art which have been developed for the fulfillment of countless objectives and requirements.

Known prior art mops and related buckets include U.S. Pat. No. 3,947,913; U.S. Pat. No. 4,735,332; U.S. Pat. No. 4,741,064; U.S. Pat. No. 3,036,322; U.S. Pat. No. 1,627,383; and Foreign Patents WO 89/12419 and WO 88/01484.

In these respects, the floor mopping system according to the present invention substantially departs from the conventional concepts and designs of the prior art, and in so doing provides an apparatus primarily developed for the purpose of conveniently mopping a floor in an effective manner.

SUMMARY OF THE INVENTION

In view of the foregoing disadvantages inherent in the known types of mops and related buckets now present in the prior art, the present invention provides a new floor mopping system construction wherein the same can be utilized for conveniently mopping a floor in an effective manner.

The general purpose of the present invention, which will be described subsequently in greater detail, is to provide a new floor mopping system apparatus and method which has many of the advantages of the mops and related buckets mentioned heretofore and many novel features that result in a new floor mopping system which is not anticipated, rendered obvious, suggested, or even implied by any of the prior art mops and related buckets, either alone or in any combination thereof.

To attain this, the present invention generally comprises a bucket with a generally rectangular configuration. As shown in FIG. 1, the bucket has a rectangular bottom face and a peripheral side wall integrally coupled to a periphery of the bottom face and extending upwardly therefrom. It should be noted that the peripheral side wall is defined by a pair of large side faces and a pair of small end faces. As such, an interior space and an open top are defined. An upper peripheral edge of the bucket preferably has a semicircular cross-section along a length thereof. For carrying purposes, the bucket further includes an inverted U-shaped handle pivotally coupled to the side faces of the peripheral side wall at a central extent thereof. With reference now to FIG. 4, a mop head is provided including a central mount having a hemispherical configuration with a dome-shaped top face and a planar bottom face. A threaded sleeve is integrally coupled to an apex of the central mount and extends upwardly therefrom for engaging an end of a handle. A pair of radially extending drain holes are formed between the top and bottom faces of the central mount on diametrically opposed points adjacent the threaded sleeve. Mounted along an intersection of the top face and bottom face of the central mount is at least one scraper. As shown in FIG. 4, the scraper includes a tapering thickness, a generally rectangular periphery and a sharpened outboard edge. For cleaning purposes, a plurality of cotton strands are coupled to the bottom face of the central mount. Next provided is a drain including a top face having a generally rectangular configuration. As shown in FIG. 2, the top face of the drain is equipped with a width equal to that of the bucket and a length equal to half that of the bucket. The top face of the drain further includes a central opening with a surrounding upwardly extending annular protrusion. A peripheral edge of the top face has an inverted U-shaped cross-section along three sides thereof. By this structure, an annular well is defined between the annular protrusion and peripheral edge. Note FIG. 3. In use, the peripheral edge is adapted to engage a half of the upper peripheral lip of the bucket. The drain further includes a plurality of radially extending linear slots formed along the annular protrusion and well. Such slots permit fluid within the well to drain into the bucket. The drain further includes a pair of resilient tabs each having a U-shaped cross-section with a reduced diameter with respect to the peripheral edge of the drain. A planar grip is integrally coupled to a top apex of the tab and extends outwardly therefrom. An inboard edge of each tab is integrally coupled within an associated cut out formed in the peripheral edge of the drain to form a living hinge. The tabs are thus adapted to snappily engage the upper peripheral lip of the bucket. The drain further includes a mop handle clip formed of a semicircular cut out formed in the top face of the drain. The cut out is preferably positioned at an end of the free edge of the peripheral edge of the drain. A horizontally oriented C-shaped member is coupled to the top face within the cut out. The C-shape member functions to releasably engage the handle of the mop head. Finally, the drain is equipped with a central portion including a cylindrical upper extent coupled to a periphery of the opening of the top face of the drain. The upper extent of the central portion depends from the top face in perpendicular relationship therewith. The central portion further has a hemispherical lower extent. As shown in FIGS. 2 & 3, both extents of the central portion include a plurality of rectangular cut outs formed therein for allowing a user to remove fluid from the mop head.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new floor mopping system apparatus and method which has many of the advantages of the mops and related buckets mentioned heretofore and many novel features that result in a new floor mopping system which is not anticipated, rendered obvious, suggested, or even implied by any of the prior art mops and related buckets, either alone or in any combination thereof.

It is another object of the present invention to provide a new floor mopping system which may be easily and efficiently manufactured and marketed.

It is a further object of the present invention to provide a new floor mopping system which is of a durable and reliable construction.

An even further object of the present invention is to provide a new floor mopping system which is susceptible of a low cost of manufacture with regard to both materials and labor, and which accordingly is then susceptible of low prices of sale to the consuming public, thereby making such floor mopping system economically available to the buying public.

Still yet another object of the present invention is to provide a new floor mopping system which provides in the apparatuses and methods of the prior art some of the advantages thereof, while simultaneously overcoming some of the disadvantages normally associated therewith.

Still another object of the present invention is to provide a new floor mopping system for conveniently mopping a floor in an effective manner.

Even still another object of the present invention is to provide a new floor mopping system that includes a bucket with an open top having an upper peripheral edge. Mounted on the upper peripheral edge of the bucket is a drain which is adapted to cover only a portion of the open top for permitting access to the bucket with a mop head and further allowing the removal of fluid from the mop head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
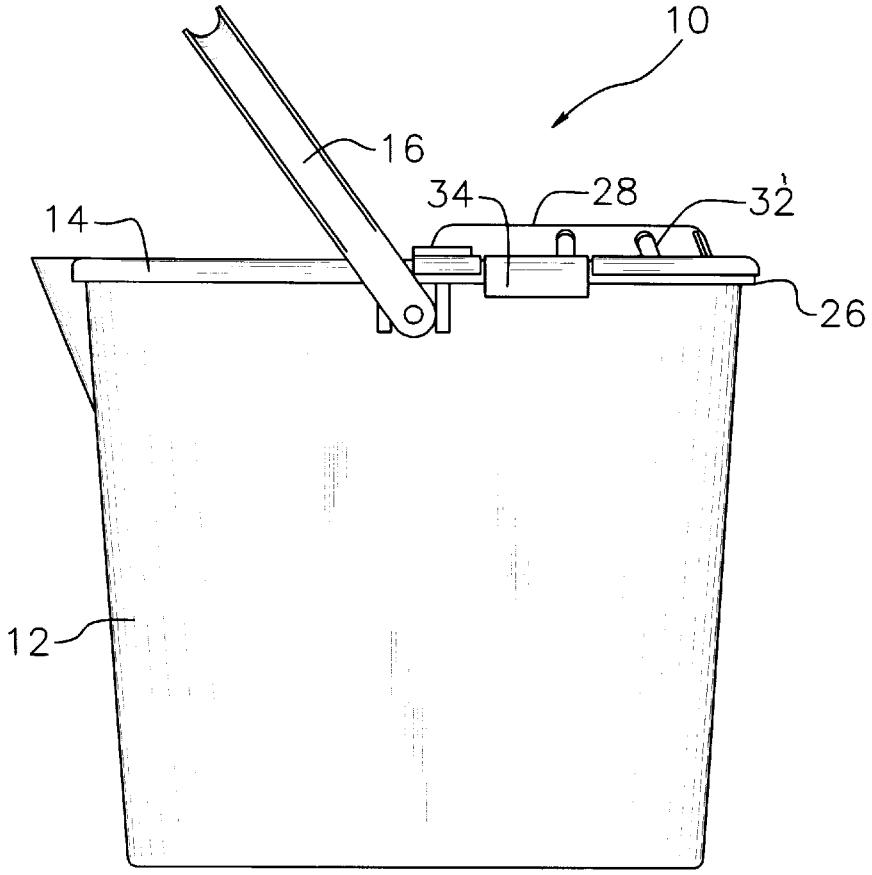
FIG. 1 is a side view of a new floor mopping system according to the present invention.

With reference now to the drawings, and in particular to FIGS. 1 through 4 thereof, a new floor mopping system embodying the principles and concepts of the present invention and generally designated by the reference numeral 10 will be described.

The present invention, designated as numeral 10, includes a bucket 12 with a generally rectangular configuration. As shown in FIG. 1, the bucket has a rectangular bottom face and a peripheral side wall integrally coupled to a periphery of the bottom face and extending upwardly therefrom. It should be noted that the peripheral side wall is defined by a pair of large side faces and a pair of small end faces. As such, an interior space and an open top are defined. The bottom face of the bucket preferably has a recess formed therein for being gripped when the bucket is being emptied. An upper peripheral edge 14 of the bucket preferably has a semicircular cross-section along a length thereof. For carrying purposes, the bucket further includes an inverted U-shaped handle 16 pivotally coupled to the side faces of the peripheral side wall at a central extent thereof.

Figure 4:
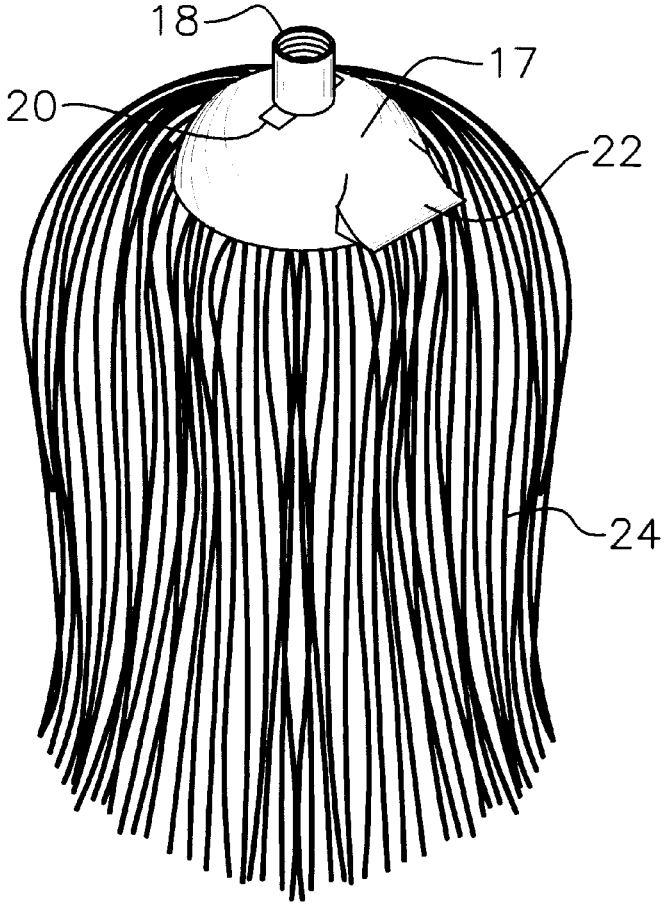
FIG. 4 is a perspective view of the mop head of the present invention.

With reference now to FIG. 4, a mop head 17 is provided including a central mount having a hemispherical configuration with a dome-shaped top face and a planar bottom face. A threaded sleeve 18 is integrally coupled to an apex of the central mount and extends upwardly therefrom for engaging an end of a handle. A pair of radially extending drain holes 20 are formed between the top and bottom faces of the central mount on diametrically opposed points adjacent the threaded sleeve.

Mounted along an intersection of the top face and bottom face of the central mount is at least one rigid scraper 22. As shown in FIG. 4, the scraper includes a tapering thickness, a generally rectangular periphery and a sharpened outboard edge. A length of such outboard edge is preferably about ½ that of a diameter of the central mount. The scraper remains generally in coplanar relationship with the bottom face of the central mount and in perpendicular relationship with the handle connected to the mop head. For cleaning purposes, a plurality of cotton strands 24 are coupled to the bottom face of the central mount.

Figure 2:
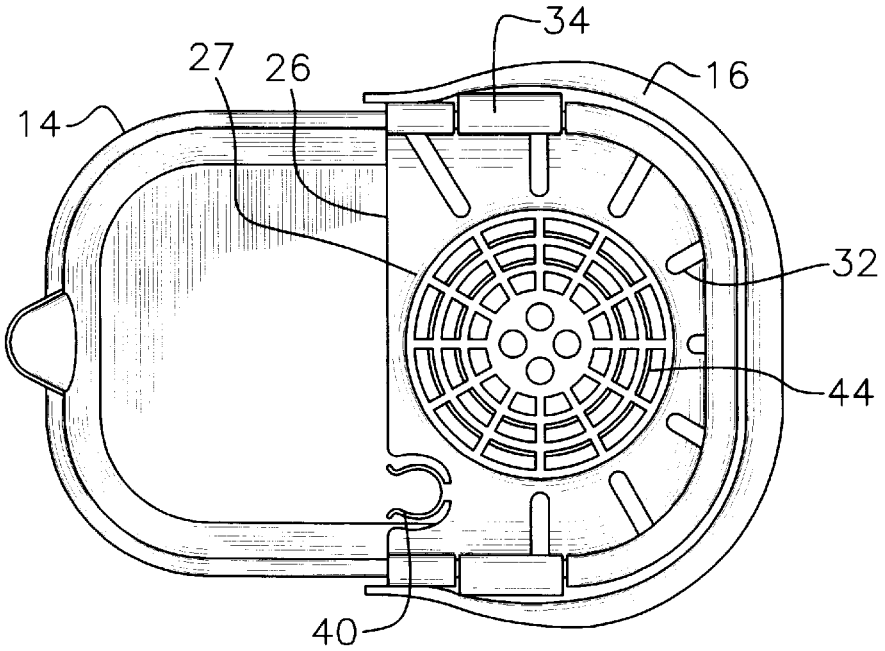
FIG. 2 is a top view of the present invention.

Next provided is a drain 26 including a top face having a generally rectangular configuration. As shown in FIG. 2, the top face of the drain is equipped with a width equal to that of the bucket and a length equal to half that of the bucket. The top face of the drain further includes a central opening 27 with a surrounding upwardly extending annular protrusion 28. A peripheral edge of the top face has an inverted U-shaped cross-section along three sides thereof. By this structure, an annular well is defined between the annular protrusion and peripheral edge. It should be noted that the annular protrusion extends above the peripheral edge of the drain. Note FIG. 3. In use, the peripheral edge is adapted to engage a half of the upper peripheral lip of the bucket. The drain further includes a plurality of radially extending linear slots 32 formed along the annular protrusion and well. During operation, such slots permit fluid within the well to drain into the bucket.

The drain further includes a pair of resilient tabs 34 each having a U-shaped cross-section with a reduced diameter with respect to the peripheral edge of the drain. A planar grip 36 is integrally coupled to a top apex of each tab and extends outwardly therefrom. An inboard edge of each tab is integrally coupled within an associated cut out formed in the peripheral edge of the drain to form a living hinge. The tabs are thus adapted to snappily engage the upper peripheral lip of the bucket.

The drain further includes a mop handle clip 40 situated within a semicircular cut out formed in the top face of the drain. The cut out is preferably positioned at an end of the free side of the peripheral edge of the drain. A horizontally oriented resilient C-shaped member is coupled to the top face within the cut out. The C-shape member functions to releasably engage the handle of the mop head.

Figure 3:
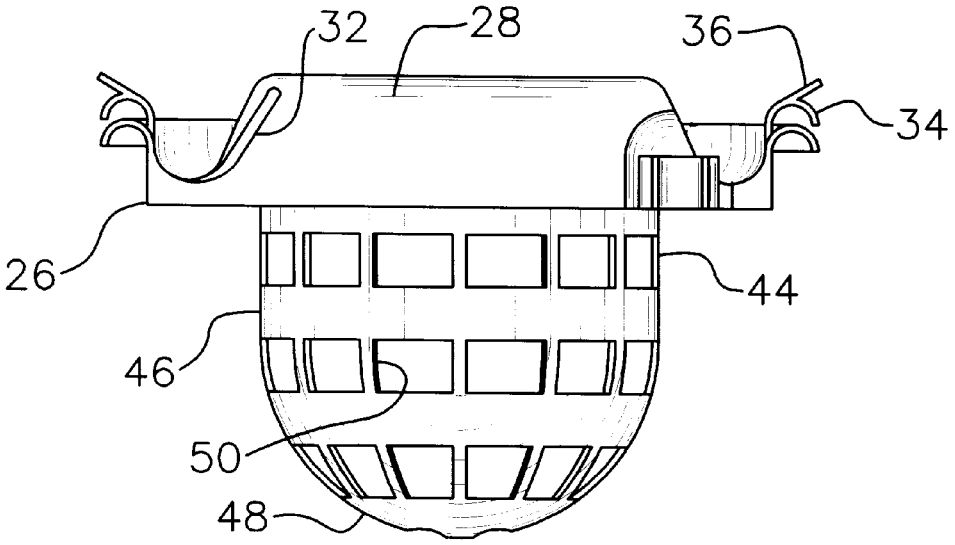
FIG. 3 is a side view of the drain of the present invention removed from the bucket.

Finally, the drain is equipped with a central portion 44 including a cylindrical upper extent 46 coupled to a periphery of the opening of the top face of the drain. The upper extent of the central portion depends from the top face in perpendicular relationship therewith. The central portion further has a hemispherical lower extent 48. Ideally, the central portion depends within the bucket a depth equal to about ½ a height of the bucket. As shown in FIGS. 2 & 3, both extents of the central portion include a plurality of cut outs 50 formed therein. Theses cut outs preferably include a plurality of rectangular cut outs formed about concentric circles on the central portion and at least four circular cut outs formed in a center of the lower extent of the central portion. In use, the cut outs of the central portion are adapted for allowing a user to remove fluid from the mop head.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mopping system comprising, in combination:

a bucket with a generally rectangular configuration having a rectangular bottom face and a peripheral side wall integrally coupled to a periphery of the bottom face and extending upwardly therefrom, the peripheral side wall defined by a pair of large side faces and a pair of small end faces for defining an interior space and an open top with an upper peripheral edge having a semicircular cross-section along a length thereof, the bucket further including an inverted U-shaped handle pivotally coupled to the side faces of the peripheral side wall at a central extent thereof;

a mop head including a central mount having a hemispherical configuration with a dome-shaped top face and a planar bottom face, a threaded sleeve integrally coupled to an apex of the central mount and extending upwardly therefrom for engaging an end of a handle, a pair of radially extending drain holes formed between the top and bottom faces of the central mount on diametrically opposed points adjacent the threaded sleeve, at least one scraper mounted along an intersection of the top face and bottom face, the scraper including a tapering extent, a generally rectangular periphery including a sharpened outboard edge, and a plurality of cotton strands coupled to the bottom face of the central mount; and a drain including a top face having a generally rectangular configuration with a width equal to that of the bucket and a length equal to half that of the bucket, the top face of the drain further including a central opening with a surrounding upwardly extending annular protrusion and a peripheral edge having an inverted U-shaped cross-section along three sides thereof for defining an annular well with the annular protrusion, wherein the peripheral edge is adapted to engage a half of the upper peripheral lip of the bucket with a single free edge, the drain further including a plurality of radially extending linear slots formed along the annular protrusion and well for draining fluid therein into the bucket, the drain further including a pair of resilient tabs each having a U-shaped cross-section with a reduced diameter, a planar grip integrally coupled to a top apex of the tab and extending outwardly therefrom, and an inboard edge integrally coupled within an associated cut out formed in the peripheral edge of the drain to form a living hinge whereby the tabs are adapted to snappily engage the upper peripheral lip of the bucket, the drain further including a mop handle clip having a semicircular cut out formed in the top face of the drain at an end of the free edge of the peripheral edge of the drain and a horizontally oriented C-shaped member coupled to the top face within the cut out for releasably engaging the handle of the mop head, the drain further equipped with a central portion including a cylindrical upper extent coupled to a periphery of the opening of the top face of the drain and depending therefrom and a hemispherical lower extent, wherein both extents of the central portion include a plurality of rectangular cut outs formed therein for allowing a user to remove fluid from the mop head.

2. A mopping system comprising:

a bucket with an open top having an upper peripheral edge;

a drain mounted on the upper peripheral edge of the bucket and adapted to cover only a portion of the open top for permitting access to the bucket with a mop head and further allowing the removal of fluid from the mop head; and wherein the drain includes a clip for engaging a handle of the mop head.

3. The mopping system as set forth in claim 2 wherein the drain includes a well formed about a central portion thereof with a plurality of drain apertures formed therein.

4. The mopping system as set forth in claim 2 wherein the drain includes at least one tab hingably mounted thereon for snappily engaging the upper peripheral edge of the bucket.

5. A mopping system comprising:

a handle including an elongated linear post; and a mop head including a central mount being coupled to the handle, a plurality of strands coupled to the central mount, and a scraper formed on the central mount.

6. The mopping system as set forth in claim 5 wherein the scraper extends radially from the central mount.

7. The mopping system as set forth in claim 5 wherein the scraper has a tapering thickness and a sharp linear outboard edge.

8. The mopping system as set forth in claim 5 wherein the scraper generally resides in a plane which remains perpendicular with respect to the handle.

* * * * *